United States Patent [19]

Davids et al.

[11] Patent Number: 4,958,985

[45] Date of Patent: Sep. 25, 1990

[54] PERFORMANCE LOW PRESSURE END BLADING

[75] Inventors: Joseph Davids, Maitland; George J. Silvestri, Jr., Winter Park, both of Fla.

[73] Assignee: Westinghouse Electric Corp., Pittsburgh, Pa.

[21] Appl. No.: 317,495

[22] Filed: Mar. 1, 1989

[51] Int. Cl.[5] ..... F04D 29/56

[52] U.S. Cl. ..... 415/101; 415/1; 415/914

[58] Field of Search ..... 415/101, 99, 181, 914, 415/93, 1; 60/692, 693

[56] References Cited

U.S. PATENT DOCUMENTS

| | | | |
|---|---|---|---|
| 3,529,631 | 9/1970 | Riollet | 415/914 |
| 4,420,288 | 12/1983 | Bischoff | 415/914 |
| 4,557,113 | 12/1985 | Silvestri, Jr. et al. | 60/693 |

*Primary Examiner*—John T. Kwon

[57] ABSTRACT

A method for optimizing thermodynamic performance of a steam turbine by matching a last stage blade flow area to condenser pressure by adjusting blade angular orientation to set gaging to an optimum value. The method is also used to correct incidence by setting blade angular orientation upstream of the last blade row.

5 Claims, 3 Drawing Sheets

PERFORMANCE LOW PRESSURE END BLADING

BACKGROUND OF THE INVENTION

This invention relates to steam turbines and, more particularly, to a method for optimizing for different exhaust pressures and different levels of mass flow without different size final stage turbine blades.

The traditional approach to meeting the needs of the electric utilities over the years was to build larger units requiring increased exhaust annulus area with successive annulus area increases of about 25%. In this way, a new design with a single double flow exhaust configuration would be offered instead of an older design having the same total exhaust annulus area but with two double flow LP turbines. The newer design would have superior performance in comparison to the old design because of technological advances.

In recent years, the market has emphasized replacement blading on operating units to extend life, to obtain the benefits of improved thermal performance (both output and heat rate), and to improve reliability and correction of equipment degradation. In addition, the present market requires upgraded versions of currently available designs with improved reliability, lower heat rate and increased flexibility. If the new designs were retrofittable on the older counterparts as well as being the optimum configurations for the diversity of applications, substantial economies could be achieved in both engineering and manufacturing resources.

The latter stages of the steam turbine, because of their length, produce the largest proportion of the total turbine work and therefore have the greatest potential for improved heat rate. The last turbine stage operates at variable pressure ratio and consequently this stage design is extremely complex. Only the first turbine stage, if it is a partial-arc admission design, experiences a comparable variation in operating conditions. In addition to the last stage, the upstream low pressure (LP) turbine stages can also experience variations on operating conditions because of (1) differences in rated load end loading, (2) differences in site design exhaust pressure and deviations from the design values, (3) hood performance differences on various turbine frames, (4) LP inlet steam conditions resulting from cycle steam conditions and cycle variations, (5) location of extraction points, (6) operating load profile (base load versus cycling) and (7) zoned or multi-pressure condenser applications versus unzoned or single pressure condenser applications.

While all but the lowest pressure feedwater heater extraction flow vary linearly with and in direct proportion to unit throttle flow, the lowest pressure heater extraction flow varies at a greater rate than the throttle flow and also varies in response to changes in condenser pressure. This produces changes in inlet angle to the downstream stage and to a lesser extent affects the performance of the stage that immediately preceded this extraction point.

Since the last few stages in the turbine are tuned, tapered, twisted blades with more selective inlet angles, the seven factors identified above have greater influence on stage performance.

FIG. 1 illustrates the effect of end loading in the inlet angle to the last stage stationary blade of an exemplary steam turbine. This graph plots "incidence" on the vertical axis against blade height on the horizontal axis for two different values of end loading, one at 6000 lb/hr/ft$^2$ (=29280 kg/hr/m$^2$) and the other at 11500 lb/hr/ft$^2$ (=56120 kg/hr/m$^2$). The dashed lines represent predicted values while the shaded areas represent ranges of measured values. Incidence is the difference between the blade and fluid angles at inlet. Note that while the incidence angle varies about the predicted design angle at full load, the incidence angle deviates from the predicted angle at partial load. Similar changes in inlet angle but of lesser magnitude were identified on the next upstream stator blade.

There are many variations in extraction arrangements and standard blade gagings for steam turbines. Many of the differences between the L-2 stator blade gagings relate to non-reheat versus reheat applications. Furthermore, single flow elements of triple flow LP frames have different extraction arrangements but the same blading as the double flow element. In the triple flow systems, only one of the two flow paths (single flow or double flow) can be matched from the standpoint of incidence.

If a double flow LP turbine were operating at optimum efficiency at a given exhaust pressure with a single pressure condenser and if the condenser were converted to a two zone multi-pressure condenser with the same surface area, the pressure at one end of the double flow element would increase while the pressure at the other end would decrease. Neither end would be operating at optimum efficiency although there would be an improvement in heat rate because the average condenser pressure would be lower with the zoned condenser. The end with the lower exhaust pressure needs more flow area while the end with the higher exhaust pressure needs less flow area. Prior studies have demonstrated that the total exhaust area for the optimum zoned condenser application is about the same or slightly smaller than the total flow area of the unzoned arrangement. The conventional approach to optimizing such a system would be to select different size last row blades in each half of the zoned double flow LP element. This would result in a greater proliferation of blade sizes to achieve optimum performance.

SUMMARY OF THE INVENTION

It is an object of the present invention to provide a method for improving steam turbine efficiency.

It is another object of the present invention to provide a method of improving steam turbine efficiency without changing the sizing of last row blades in a low pressure turbine section.

The above and other objects, features and advantages are attained in a plurality of steam turbines with a minimum number of last row blade sizes by setting blade gaging for an optimum flow area.

Blade row flow (throat) area as well as blade annulus area determine blading performance. The ratio of flow area to annulus area is termed gaging and is a measure of the blade outlet area. The gaging, g, is the sine of the blade outlet angle and is also the ratio of the blade throat opening to the blade pitch on convergent (non-expanding) flow passages.

Accordingly, the same flow area is obtained by either using a given blade with a large gaging or a somewhat larger blade with a smaller gaging. In fact, a large change in blade row area can be realized by varying the blade outlet angle. For example, a blade with a 30° outlet angle, which has a gaging of 0.500, can, by rotation of ±2°, have a gaging range of 0.467 to 0.530, a 14% change.

The next larger blade size could be 25% larger in annulus area but with a gaging variation such that its minimum gaging orientation would have a somewhat smaller blade flow (throat) area than the smaller blade at its maximum gaging orientation. Thus, a broad range of optimal flow areas can be attained by use of only a few blades through selection of the optimum gaging of the last row blades using blade orientation.

In selecting the optimum last row gagings, the units with the better hoods have higher optimum gagings than the units with poorer hoods. Applying the teachings of this invention, the same last row blade, set at various gagings, would optimize the application for the various hoods rather than selecting a gaging that favors one end of the hood spectrum at the expense of the other or designing a blade that is some sort of compromise.

The present invention thus comprises a method for optimizing thermodynamic performance of a steam turbine by matching a last stage blade flow area to condenser pressure by adjusting blade angular orientation to set gaging to an optimum value. Furthermore, the invention includes a method for correcting incidence by setting blade angular orientation upstream of the last blade row.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 2:
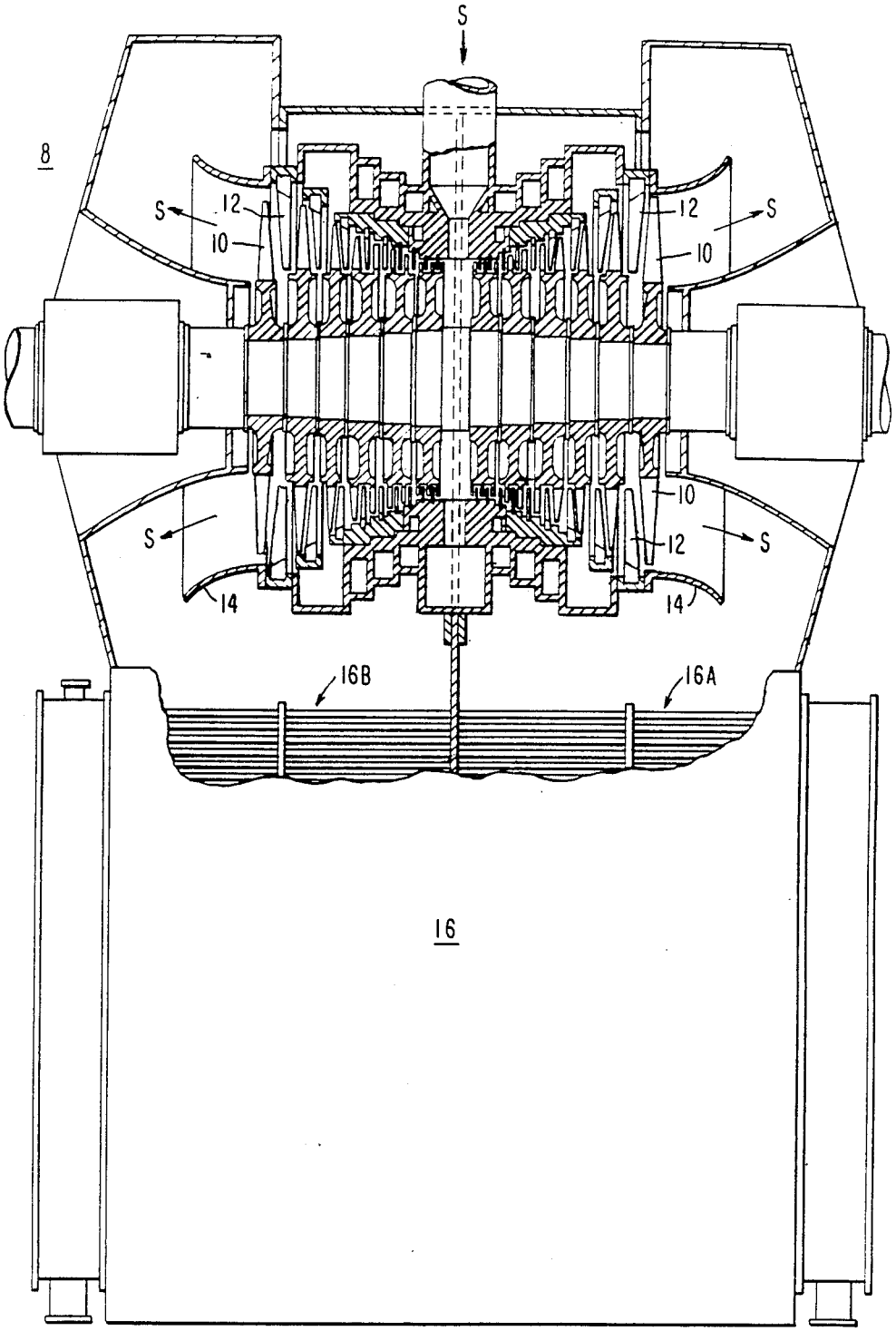
FIG. 2 is a partial cross-sectional view of a double flow LP steam turbine stage and a zoned or multi-pressure condenser.

Referring to FIG. 2, there is shown a partial cross-sectional view of a low pressure (LP) section of a double flow steam turbine 8. Steam flow is indicated at S. After passing through a plurality of rotating blades 10 and stationary nozzles 12, the steam S exits through hoods 14. The hoods 14 convey the exhausted steam to a condenser 16 which cools the steam, converting it to water, which is then returned to a boiler (not shown) to be converted back to steam.

The condenser 16 may be zoned or non-zoned. The zoned condenser is divided into sections 16A and 16B with steam in one section being isolated from steam in the other. Zoned condensers are used in turbines employing multiple exhaust ends. In such turbines, steam from a given LP flow path is directed to one zone of the condenser so that it can be cooled, while steam from another LP flow path is directed into another zone of the condenser. Such turbines are designed to develop additional power from downstream turbine stages. A more detailed description of a turbine with zoned condenser may be had by reference to U.S. Pat. No. 4,557,113 assigned to Westinghouse Electric Corporation.

The typical zoned condenser has a lower average condenser pressure than an unzoned condenser. The conventional single last row blade gaging of a steam turbine coupled to the zoned condenser would be nonoptimum for both zones of the zoned condenser. In accordance with conventional practice, two completely different last row blades would be needed to optimize the zoned condenser application and still another new blade would be needed for the unzoned application. With the teachings of this invention, the same last row blade would be used but with different gagings to meet the requirements of different exhaust pressures. The higher exhaust pressures would have the smaller gagings. The differences in orientation required to vary the gagings of a given blade would have negligible effect on the frequency of the tuned blades.

Figure 3:
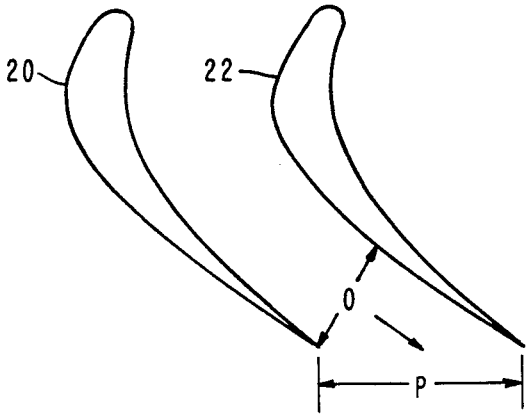
FIG. 3 is a radial cross-sectional view of adjacent steam turbine blades illustrating throat and pitch dimensions used to establish gaging.

FIG. 3 is an end view in cross-section, i.e., a radially directed cross-sectional view, of a pair of adjacent steam turbine blades 20 and 22. The perpendicular distance 0 represents the throat or flow opening while the dimension P represents the pitch. For evenly spaced blades, pitch is the circumference divided by the number of blades. Gaging is defined as the ratio of net flow area to annular area which can be expressed as opening/pitch (O/P), where the opening is the width normal to the flow at the blade throat. It can be shown that the fluid angle exiting the blades can be represented by arcsin O/P so that fluid angle and gaging are clearly related.

Figure 1:
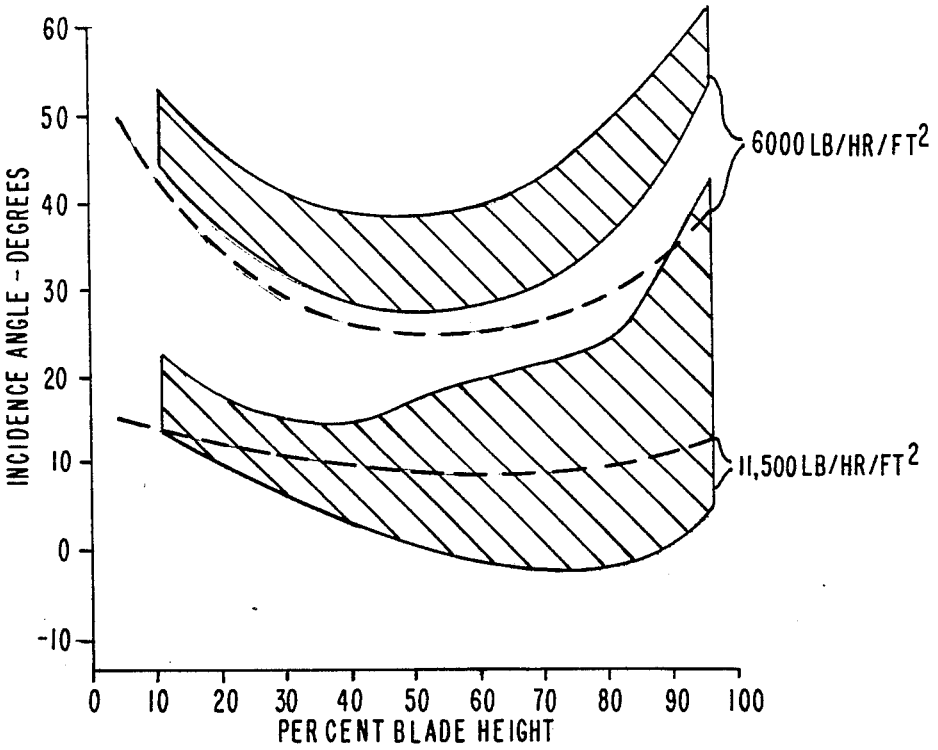
FIG. 1 is a graph illustrating incidence angle as a function of blade height for two different turbine end loading conditions comparing calculated versus measured values.

Variations in end loading affect the optimum gaging selection. Therefore, variations in blade orientation can be used to optimize the turbine heat rate for a myriad of applications. FIG. 1, however, illustrates that variations in end loading change the inlet angle to the stationary blade, producing incidence and an accompanying efficiency degradation. Table I illustrates the effect of gaging variations on the L-2C blade row. The lowest gagings occur in nonreheat applications (lower specific volume) while higher gagings occur in reheat units.

The illustrated stationary blade gaging changes were made to reduce the incidence (deviation from design angle) on the mating rotating blades but the stationary blades were new designs. With gaging variations produced by changing the orientation of the rotating and stationary blades ahead of the last rotating row as well, a greater degree of performance optimization can be achieved without changing the blade profiles. It should be noted that the design of the stationary blades is much simpler than the design of the mating rotating blade and the cost of the stationary blade is considerably lower than the cost of the rotating blade.

Figure 4:
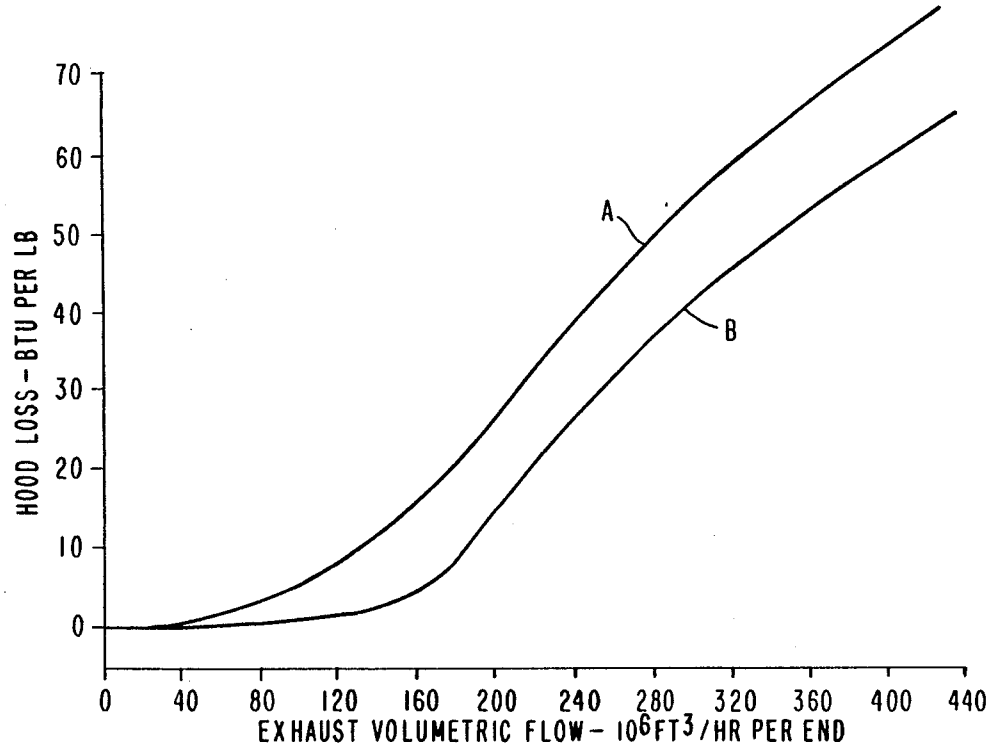
FIG. 4 is a graph illustrating hood loss in BTU per pound as a function of exhaust volumetric flow for two different hood configurations.

An example of losses attributable to different exhaust hood designs is shown in FIG. 4. Here, two substantially identical turbines are each coupled to substantially identical condensers using two different hood designs. The curve labeled A illustrates a larger pressure loss from blading to the condenser than is shown by curve B. Different hoods thus result in different exhaust pressures for the same mass flow and condenser pressure. As is well known, blade pressure determines the amount of work which can be extracted from a given turbine. The present invention provides a method for compensating for differences in hood designs by adjusting blade gaging to an optimum value for the exhaust pressure.

Incidence also results from changes in steam extraction arrangements, particularly in regard to the location of the lowest pressure extractions in which the extracted mass flow varies with condenser pressure. Accordingly, gaging could be used to correct incidence at blade rows adjacent steam extraction positions although changes in stator blade orientation only may be sufficient.

Moreover, the inlet flow angles to the end blades in a single flow element will be different than the inlet flow angle to the blades of a double flow element of a triple flow exhaust unit. The triple flow units may have a different extraction arrangement on the single flow element than on the double flow element of other units. To achieve the gaging changes, the same blade could be oriented differently on the root platform or the rotor steeple could be oriented differently or a combination of the two.

The present invention achieves higher LP turbine efficiency by increasing the optimum performance range over which a blade of given profile is used. Many more different blade designs would be needed to achieve the same result with conventional practice. This concept is applicable to the blade rows of the last rotating row, both stationary and rotating blades, as well as the next two upstream stages although the effects are lesser in magnitude.

While the principles of the invention have now been made clear in an illustrative embodiment, it will become apparent to those skilled in the art that many modifications of the structures, arrangements and components presented in the above illustrations may be made in the practice of the invention in order to develop alternative embodiments suitable to specific operating requirements without departing from the scope and principles of the invention as set forth in the claims which follow.

TABLE I

| Exit Angle Degrees | Gaging, g Percent | Exit Angle Degrees | Gaging, g Percent |
|---|---|---|---|
| 22 | 37.5 | 31 | 51.5 |
| 23 | 39.1 | 32 | 53.0 |
| 24 | 40.7 | 33 | 54.5 |
| 25 | 42.3 | 34 | 55.9 |
| 26 | 43.8 | 35 | 57.4 |
| 27 | 45.4 | 36 | 58.8 |
| 28 | 46.9 | 37 | 60.6 |
| 29 | 48.5 | 38 | 61.6 |
| 30 | 50.0 | | |

What is claimed is:

1. A method for optimizing thermodynamic performance of a steam turbine by matching a last stage blade flow area to condenser pressure without changing blade sizing and shape comprising the step of adjusting blade angular orientation to set the gaging for an optimum flow area for the designed condenser pressure.

2. The method of claim 1 and including the step of orienting the blades upstream of the last stage such that steam incidence is minimized.

3. The method of claim 2 wherein the step of orienting includes the steps of setting the angular orientation of both rotating and stationary blades.

4. The method of claim 2 wherein the step of orienting includes the steps of setting the angular orientation of blades adjacent steam extraction points.

5. In a multiple exhaust steam turbine coupled to a zoned condenser, a method for optimizing efficiency of the last stage blading of each turbine section coupled to corresponding condenser zones without changing blade sizes and shapes, comprising the step of adjusting gaging for each last stage to provide a optimal flow area for the designed pressure in the corresponding condenser zone.

* * * * *